US005536017A

United States Patent [19]

Salisian

[11] Patent Number: 5,536,017

[45] Date of Patent: Jul. 16, 1996

[54] ARCADE TYPE WALL MOUNTED GAME

[76] Inventor: Harold Salisian, 2 S. Golden West Ave., Arcadia, Calif. 91007

[21] Appl. No.: 414,920

[22] Filed: Mar. 31, 1995

[51] Int. Cl.[6] ..... F41J 5/052

[52] U.S. Cl. ..... 273/375; 273/401

[58] Field of Search ..... 273/371, 373–376, 273/398–402, 415; D21/6

[56] References Cited

U.S. PATENT DOCUMENTS

| | | | |
|---|---|---|---|
| 1,072,954 | 9/1913 | Junn | 273/398 X |
| 1,541,980 | 6/1925 | Luber | 273/401 X |
| 1,558,401 | 10/1925 | Sato | 273/375 |
| 1,569,727 | 1/1926 | Donato | 273/376 |
| 1,824,811 | 9/1931 | Gade | 273/375 |
| 2,501,218 | 3/1950 | Hill | D21/6 X |
| 2,540,288 | 2/1951 | Powers | 273/402 |
| 3,550,941 | 12/1970 | Spiro | 273/375 |
| 3,594,006 | 7/1971 | Clatt | 273/375 X |
| 3,604,707 | 9/1971 | Hurley | 273/85 |
| 3,762,708 | 10/1973 | Hing | 273/402 X |
| 4,151,994 | 5/1979 | Stalberger, Jr. | 273/415 X |
| 4,919,436 | 4/1990 | Buselli | 273/415 X |
| 4,927,160 | 5/1990 | Nichol et al. | 273/402 X |
| 4,938,485 | 7/1990 | Hockridge et al. | 273/401 |
| 5,056,795 | 10/1991 | Bushrow | 273/415 X |
| 5,358,253 | 10/1994 | Chen | 273/371 X |

FOREIGN PATENT DOCUMENTS

| | | | |
|---|---|---|---|
| 465817 | 12/1937 | United Kingdom | 273/375 |
| 1532744 | 11/1978 | United Kingdom | 273/376 |

*Primary Examiner*—Paul E. Shapiro
*Attorney, Agent, or Firm*—Gene Scott

[57] ABSTRACT

A pocketed wall game having a wall mounted target board with one or more recessed pockets designed to accept and retain a plurality of soft projectiles. Each time a projectile is tossed into one of the pockets, both light and sound means are preferably actuated so that the board lights up and emits a sound effect after each successful toss. An electronic scoreboard may also be included so as to keep a running total of the players' scores.

10 Claims, 2 Drawing Sheets

ARCADE TYPE WALL MOUNTED GAME

FIELD OF THE INVENTION

This invention relates generally to wall mounted games and more particularly to an inventive new wall mounted game in which players toss soft projectiles at a wall mounted target board with a plurality of different sized target pockets.

BACKGROUND OF THE INVENTION

Invention and use of wall mounted games is known to the public, perhaps the most popular wall game being darts. Generally, dart games consist of a round target board at which a plurality of darts are thrown from a designated distance. A wide variety of different games can be played with these dart boards, but, in essence, the object of each game is to throw the darts at specific regions of the board accounting for varying levels of difficulty. Dart boards themselves come in a variety of different configurations. Although some consist of a mere target, many others are available including one with an electronic display of the players scores, running game totals and the like. Some even include a plurality of light and sound effects.

Unfortunately, the very nature of dart games makes them unsuitable for young children, as the darts are sharp and can easily hurt or injure them. In addition, these games can also be dangerous for adult play, especially in crowded environments such as in an arcade or bar. Numerous variations have been derived from the original dart board games. For example, instead of a pointed dart, magnet tipped darts or metal tipped darts with a magnetic board, or VELCRO darts are variants. Hurley U.S. Pat. No. 3,604,707 discloses a coin-operated, electronic amusement game with a wall-mounted display panel that may be selectively illuminated to provide animation for the amusement game. The game essentially involves judging the appropriate release time of an object. Animated characters are positioned on the playing board, each character simulates throwing an object, such as a dart or a baseball, at a target on the board. The players are able to watch these simulated throws, and actuate the release of the object when they deem it appropriate.

Since throwing projectiles at a target is excellent for aiding in the development of hand-eye coordination, there is a need for an improved target throwing game which is not dangerous for children and yet is challenging for them to play and exciting in sight and sound to afford greater amusement value.

The present invention fulfills these needs and provides further related advantages as described in the following summary.

SUMMARY OF THE INVENTION

The present invention is a pocketed wall game in which one or more players throw a plurality soft projectiles at a wall mounted target board. The target board has a plurality of recessed pockets in which to throw the projectiles, the basic object of the game thus being to throw as many projectiles into the pockets as possible.

The construction of both the pockets and the projectiles is such that when a projectile is thrown into one of the pockets, it is retained in the pocket until it is manually removed by the players. The projectiles are preferably constructed of a pliant, non-rebounding material so that when they are thrown into one of the recessed pockets, they do not bounce back out. Thus, unlike prior art games in which the projectiles have means by which to cling to the board, the present inventive game provides for relatively soft, non-rebounding balls to be thrown at and retained in the recessed pockets. It is therefore another object of the present invention to provide a game with projectiles that are much safer to play with and throw, thus making the game suitable for people of all ages, especially children who cannot play standard wall mounted games because of the danger of the projectiles. The present inventive game is also particularly designed for use in crowded, high traffic areas, such as coffee shops or bars, in which throwing sharp, pointed projectiles such as darts may inadvertently injure someone.

Each pocket in the game board preferably has a different shape and size, the smaller the pocket size, the more difficult it is to toss a projectile into the pocket. A single game board may include pockets of all sizes so as to accommodate players of all skill levels, or, alternately, game boards may be tailored to a particular skill level by containing pockets of approximately the same general size. For example, game boards designed for small children may have only one or two large pockets, whereas game boards designed for adults may include numerous, relatively small pockets. Thus, it is an object of the invention to provide a game that can be easily tailored to suit the needs and manual dexterity of particular age groups and skill levels. The game can also be suited to individual abilities simply by modifying the distance from which the projectiles are tossed.

Each time a projectile is thrown into one of the pockets, the thrower is awarded at least one point. If desired, each pocket may be worth a different number of points, the number of points corresponding with the size and difficulty of the particular pocket. The target board preferably includes an electronic scoring display that automatically records the players score each time a projectile is successfully tossed into one of the pockets. Thus, it is an object of the present invention to make the scoring of the game easy and convenient, while also avoiding possible arguments over the score of the game. The addition of the scoreboard makes the game ideal for children, as it effectively keeps score for those not yet able to do so by themselves. This feature also particularly suits the needs of game playing in crowded or high traffic areas in which distractions are often too great to accurately keep the score.

Each time a projectile is tossed into one of the pockets, both a light and sound means may be activated. The light means may include a plurality of different colored flashing lights positioned around the target board or in each pocket, while the sound means preferably generates a variety of different sound effects. The lighting and sound effects may be the same for each pocket, or alternately, a different sound and light effect may be emitted for each different pocket. Thus it is an object of the invention provide additional amusement and incentive for the players of the game.

Preferably, the entire game is designed around a particular theme that corresponds to the age and skill level of the intended players. For example, game boards intended for children may feature action figures, power rangers, super heroes or the like. Preferably, each pocket, includes a picture relating to this theme, and each sound effect also pertains to the particular theme. Another approach would be to enable each pocket to represent an educational element such as an answer to a particular quiz question so that upon guessing the answer correctly and throwing the projectile into the corresponding pocket, a given number of points is awarded, said number of points being related to both the difficulty factor of the question and the size of the pocket. In such an embodiment, the pockets could have a question holder for a flash card, or the score board could double as a question flashing device. Thus, it is an object of the invention to provide a game with a theme that appeals to certain age groups and enhances the fun, excitement and educational value to the players.

While throwing the projectiles into the pockets is the underlying object of the game, there are numerous different variations and possible methods of play. For example, the distance the players stand from the board can be altered, or the time that a player takes to release all the projectiles can be added in as a factor in the game. Thus, it is an object of the present invention to provide a single wall mounted target board from which any number of different games can be derived, thus keeping the attention of both children and adults for an extended period of time.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
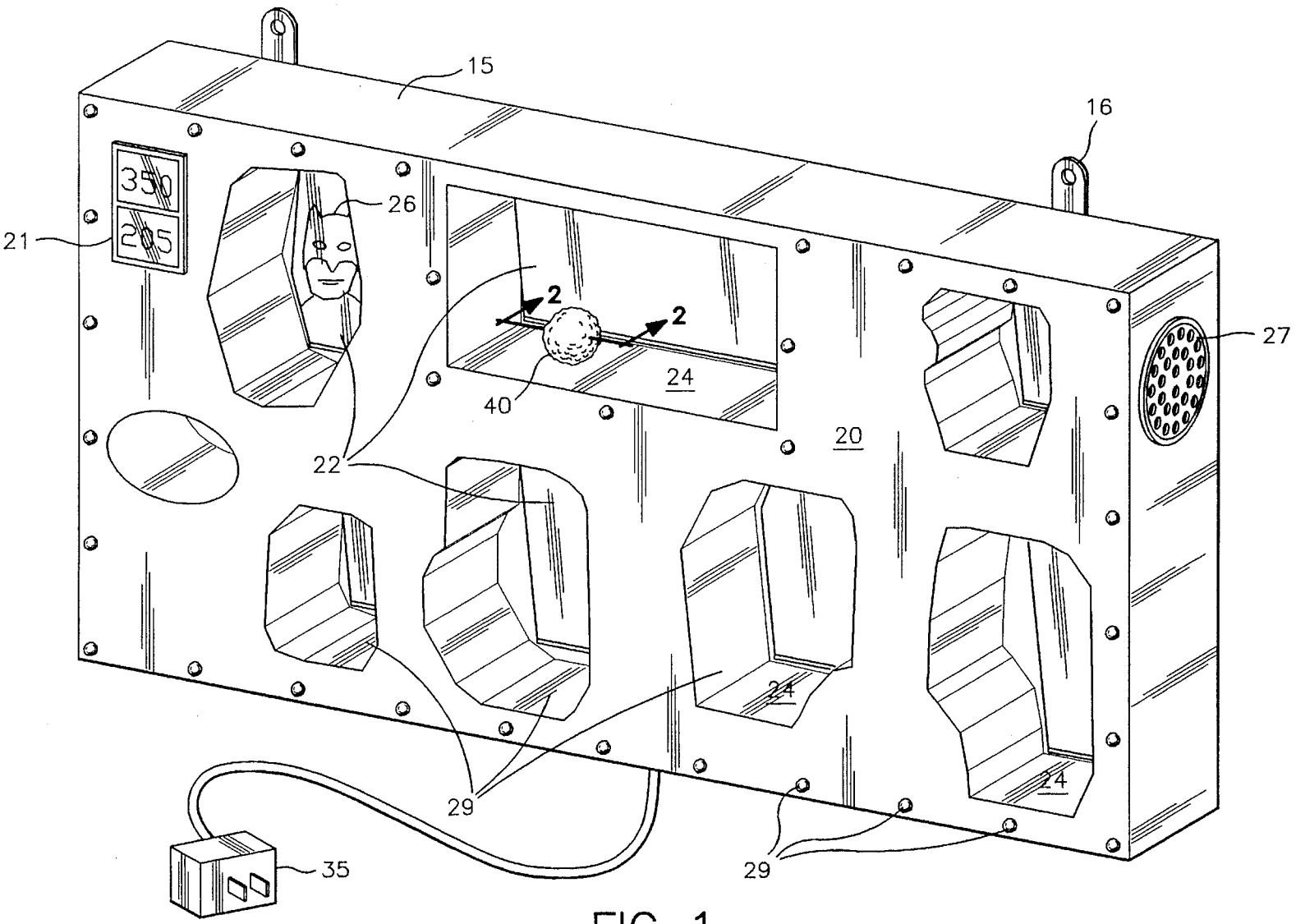
FIG. 1 is a perspective view of the preferred embodiment of the present invention, particularly showing the front face and side of the target board.
Figure 2:
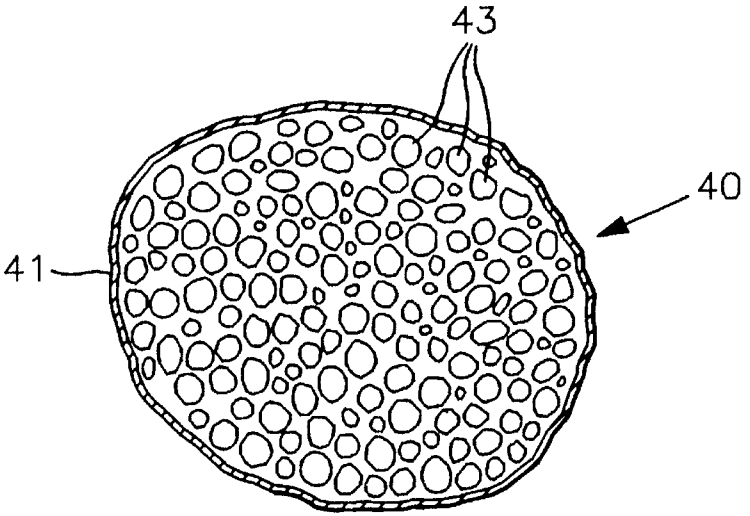
FIG. 2 is a cross sectional view taken along line 2—2 of FIG. 1, particularly showing one of many possible constructions of the soft projectiles.
Figure 3:
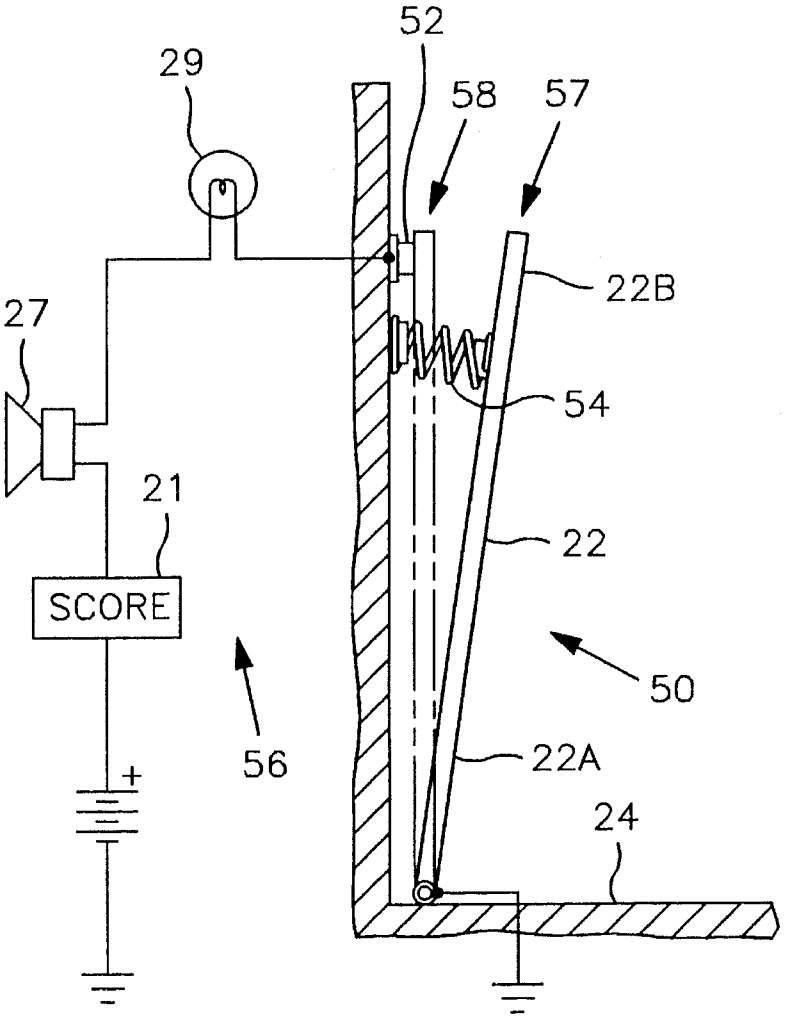
FIG. 3 is a schematic diagram of how the pockets are arranged to provide for sound and light display, particularly showing a preferable embodiment of the impact sensing means.

FIGS. 1–3 illustrate the preferred mode of the present inventive pocketed wall game that can be played by one or more players. Although there are numerous different possible game variations, the basic object of the pocketed wall game is to throw as many soft projectiles 40 as possible into designated areas of a wall mounted target board 15.

A target board 15 is constructed of a light weight material such as Styrofoam, foam rubber or paper, such that it is easily lifted and moved by a child, yet has a size and shape enabling a target surface 20 of area sufficient for placement of a plurality of targets. The target board 15 is mounted to a wall (not shown) by means of hooks, screws, nails or the like through a wall mounting means 16 such as a pair of tabs mounted to top of the target board (FIG. 1). The target surface 20 faces away from the wall and toward the players when the board 15 is properly mounted to the wall. The board's target surface 20 has at least one opening that forms a recessed pocket 25, and it preferably includes several recessed pockets 25 of different shapes and sizes, as illustrated in FIG. 1. These pockets 25 serve as targets in which to throw the soft projectiles 40, each having a back wall 22 and an upfacing surface 24. The target board has a depth sufficient to enable the pockets 25 to retain at least one of the projectiles 40.

The target board 15 includes an impact sensing means 50 within each of the pockets which is activated each time one of the projectiles 40 is thrown into the pocket 25. There are numerous possible embodiments for the impact sensing means 50 that can be implemented successfully within the scope of the present invention. In one preferable embodiment, the impact sensing means 50 consists of an electric contact 52 positioned directly behind the back wall 22 of each pocket 25. In this embodiment, illustrated in FIG. 3, a lower end 22A of the back wall 22 is pivotally mounted to the adjacent, upfacing surface 24 of the pocket 25, while the upper end 22B of the wall 22 is urged slightly forward by means of a spring 54. Thus, when the back wall 22 is struck by the projectile 40, it automatically moves from a normal, forwardly biased position 57 into an upright position 58 in which it momentarily touches the electric contact 52. Alternately, the upfacing surface 24 of the pocket 25 could be movably biased in the manner described above, in which case the electric contact 52 of the impact sensing means 50 would be positioned below the upfacing surface 24. Providing the back wall 22 as the contact surface, however, provides for more immediate feedback.

Once activated, the impact sensing means 50 closes an electric circuit 56 providing for activation of both a light means 29 and a sound means 27. The light means 29 preferably consists of a plurality of lamps that are spaced around the target board 15. When activated, the lamps may flash or blink in sequence, etc. The sound means 27, on the other hand, preferably consists of at least one electronically activated sound generating device that emits a sound from one or more speakers when activated. As illustrated in FIG. 1, the sound means 27 is preferably located on a surface other than the target surface 20, thus protecting the sound means 27 from being struck by the projectiles 40. Preferably, the light means 29 and the sound means 27 are activated simultaneously after a projectile 40 contacts the pocket's back wall 22, although they may also be activated one after another in a pre-selected desired sequence. The light and sound displays may be momentary, occurring only during the contact instant of the back wall 22 against the electric contact 52, or the circuit 56 may be more complex providing for a more elaborate display and sound effect, possibly related to the difficulty factor of each of the pockets 25. One possible embodiment includes the use of a computer chip or other controller whereby a pre-selected sequence of events occurs depending upon the particular pocket 25 that is activated by the projectile 40. For instance, the sequence could include a lamp activation sequence and a sound activation sequence possibly including different sounds or music.

Preferably, an electronic score board 21 is included on the target board 15 in a location in which it is clearly visible to the players, such as on the target surface 20 (FIG. 1). The scoreboard 21 is also activated by each of the impact sensing means 50 so that each time a projectile 40 lands in one of the pockets 25, it is recorded on the scoreboard 21. As illustrated, the scoreboard 21 preferably provides at least a digital display of the scores, although it may also include set totals, time elapsed, etc.

The target board 15 includes an electrical power source 35 for powering the electrical circuits and possible computer or controller of the invention. The power source 35 may draw energy from either an AC or DC source. The target board 15 also preferably includes a power switch (not shown) by which to turn the device on and off.

The soft projectiles 40 are preferably constructed of pliant, non-rebounding material so that when they are thrown into the recessed pockets 25, they generally do not bounce back out. It is essential that the projectiles 40 are soft enough not to damage the target surface 20, the impact sensing means 50 or other electrical components of the device upon impact. And yet, the projectiles 40 must have mass sufficient to travel smoothly through the air at a velocity sufficient to reach the pockets 25 and activate the impact sensing means 50. As illustrated in FIG. 2, projectiles 40 composed of inelastic pellets 43, such as those made of a rubber or other rubber-like substance, surrounded by a soft, flexible outer covering 41 have proven to provide these qualifies, which are essential for the intended uses of the projectiles 40.

Preferably, the entire wall game has an overall theme which is carried through in several aspects of the game. For example, the recessed pockets 25, the back wall 22 of each pocket 25, or the target surface 20 itself may all contain images 26 related to a particular desired theme. Additionally, the sound generated by the sound generating means 27 preferably relates to the overall theme of the game. Possible themes could include one for superheros of various types that are popular at the time.

Thus, to play the present inventive wall game, the target board 15 is mounted to the wall with the target surface 20 facing away from the wall, and the power source 35 engaged. The players stand a determined fixed distance from the board 15 and toss the projectiles 40 at the recessed pockets 25 in the target surface 20. The smaller the size of the pocket 25, the more difficult it is to throw the projectiles 40 into it. Preferably then, each target board 15 is constructed so that the general size of the pockets 25 of each board 15 corresponds with the skill level of the intended players of the wall game. When one of the soft projectiles 40 is thrown into one of the pockets 25, the force of the impact on the back wall 22 causes the spring 54 behind the wall to contract, which in turn causes the back wall 22 to pivot from the forwardly biased position 57 into the more upright position 58 in which it contacts the electric contact 52. The impact sensing means 50 thereby activates both the light and sound means, 29 and 27 respectively, so that the target board 15 lights up and a sound is emitted. The light and sound effects may be the same regardless of which pocket 25 the projectile 40 is thrown into, or, alternately, the light and sound effects may be different for each individual pocket 25. The fact that the back wall 22 pivots to absorb the force of impact also helps to prevent the projectile 40 from bouncing off the back wall 22 and out of the pocket 25. Instead, upon impact with the back wall 22, the projectile 40 simply falls downwardly onto the upfacing surface 24 of the pocket 25, where it is retained until it is manually removed. When the target board 15 includes an electronic score board 21, it, too, is activated by the impact sensing means 50 after each projectile 40 lands in a pocket 25. The scoreboard 21 may simply award a single point for each pocket 25, or, alternately, it may award a different number of points for each of the different pockets 25, the number of points awarded corresponding to the size and difficulty of throwing the projectile 40 into the particular pocket 25.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A soft projectile, pocketed wall game comprising:

a plurality of soft projectiles;

a wall mounted target board having light means, sound means, and a target surface with at least one opening forming at least one recessed pocket receiving and retaining the soft projectiles thrown at the target board;

within each of the at least one recessed pocket, an impact sensing means including a pivotally mounted, near vertically-oriented moveable back wall having an upper portion biased slightly forward and an adjacent electrical contact activated by a movement of the back wall, said electircal contact sending electrical signals to the light means and sound means upon impact of one of the projectiles against the moveable back wall; the projectiles being deflected downwardly into the at least one recessed pocket by the back wall.

2. The soft projectile, pocketed wall game of claim 1 wherein the at least one recessed pocket comprises a plurality of pockets of different sizes and shapes.

3. The soft projectile, pocketed wall game of claim 1 wherein the light means comprises a plurality of lights spaced around the target board and visible on the target surface.

4. The soft projectile, pocketed wall game of claim 3 wherein the sound means comprises at least one electrically activated sound generating device.

5. The soft projectile, pocketed wall game of claim 1 further comprising an electronic score board on the target board; wherein the impact sensing means activates the scoreboard.

6. The soft projectile, pocketed wall game of claim 1 further comprising, within each of the recessed pockets, a bottom upfacing surface, said surface retaining the soft projectiles upon impact therewith.

7. The soft projectile, pocketed wall game of claim 1 wherein each of the soft projectiles is constructed of non-rebounding material such that the soft projectiles, when thrown into the recessed pockets, remain in the recessed pockets.

8. The soft projectile, pocketed wall game of claim 7 wherein the soft projectiles are constructed of a soft outer covering containing inelastic pellets.

9. The soft projectile, pocketed wall game of claim 1 wherein the recessed pockets contain images related to a theme and the sound generating means generates sounds related to the theme.

10. The soft projectile, pocketed wall game of claim 9 wherein the moveable back wall of each of the recessed pockets is imprinted with an image related to the theme.

* * * * *